US006854960B2

(12) United States Patent
Van Dine et al.

(10) Patent No.: US 6,854,960 B2
(45) Date of Patent: Feb. 15, 2005

(54) SEGMENTED COMPOSITE IMPELLER/ PROPELLER ARRANGEMENT AND MANUFACTURING METHOD

(75) Inventors: Pieter Van Dine, Mystic, CT (US); Catherine Van Dine, Mystic, CT (US)

(73) Assignee: Electric Boat Corporation, Groton, CT (US)

( * ) Notice: Subject to any disclaimer, the term of this patent is extended or adjusted under 35 U.S.C. 154(b) by 0 days.

(21) Appl. No.: 10/178,190

(22) Filed: Jun. 24, 2002

(65) Prior Publication Data

US 2003/0235502 A1 Dec. 25, 2003

(51) Int. Cl.[7] ..... F04D 29/02

(52) U.S. Cl. ..... 416/191; 416/193 A; 416/195; 416/230; 416/241 A; 264/250; 264/297.2; 156/242; 156/245

(58) Field of Search ..... 416/190, 191, 416/192, 193 R, 193 A, 194, 195, 229 R, 230, 241 A; 415/200, 209.4, 210.1; 264/241, 250, 297.2; 156/242, 245

(56) References Cited

U.S. PATENT DOCUMENTS

| | | | | | |
|---|---|---|---|---|---|
| 2,283,901 | A | * | 5/1942 | Arnold | 416/191 |
| 4,365,933 | A | * | 12/1982 | Langer et al. | 415/210.1 |
| 4,483,214 | A | * | 11/1984 | Mayer | 156/245 |
| 5,399,070 | A | * | 3/1995 | Alizaden | 416/189 |
| 5,407,323 | A | | 4/1995 | Gay et al. | |
| 5,431,536 | A | | 7/1995 | By et al. | |
| 5,525,035 | A | | 6/1996 | Ben-Porat et al. | |
| 5,547,342 | A | | 8/1996 | Furseth et al. | |
| 5,609,470 | A | * | 3/1997 | Dodd | 416/192 |
| 5,655,875 | A | | 8/1997 | Sekine | |
| 5,813,832 | A | | 9/1998 | Rasch et al. | |
| 5,938,403 | A | | 8/1999 | Okada et al. | |
| 6,126,386 | A | | 10/2000 | Kohyama et al. | |
| 6,126,395 | A | | 10/2000 | Shingai | |
| 6,146,094 | A | | 11/2000 | Obana et al. | |
| 6,164,903 | A | | 12/2000 | Kouris | |
| 6,196,794 | B1 | * | 3/2001 | Matsumoto | 415/191 |
| 6,312,218 | B1 | * | 11/2001 | Beeck et al. | 415/173.7 |
| 6,340,287 | B1 | | 1/2002 | Eino | |
| 2002/0157250 | A1 | * | 10/2002 | Haendler et al. | 29/889.7 |

* cited by examiner

*Primary Examiner*—Christopher Verdier
(74) *Attorney, Agent, or Firm*—Howrey Simon Arnold & White, LLP; Michael J. Bell

(57) ABSTRACT

In the embodiments described in the specification, an impeller is manufactured by providing a mold for one angular segment containing one vane of an impeller and corresponding hub and rim portions, injection-molding fiber-reinforced polymer composite resin material into the mold to produce a plurality of substantially identical segments, and assembling the segments into an impeller by bonding corresponding mating end surfaces of the hub and rim portions of the segments. A veil cloth is applied to the outer surface of the rim portion and impregnated with resin material to complete the impeller structure.

20 Claims, 4 Drawing Sheets

SEGMENTED COMPOSITE IMPELLER/ PROPELLER ARRANGEMENT AND MANUFACTURING METHOD

BACKGROUND OF THE INVENTION

This invention relates to composite impellers and propellers for driving fluids.

Conventional high precision metal impellers and propellers are manufactured as a single unit using a five axis machine to machine the blade and hub and a shroud is separately machined and then welded to the tips of the vanes. Composite impellers and propellers are conventionally molded as a single monolithic structure which is less costly but also less precise than the five axis machining method for metal impellers and propellers.

The Shingai U.S. Pat. No. 6,126,395 discloses an axial fan assembled from two components formed by injection molding of resin material. One component is an impeller having a plurality of radial vanes molded integrally with the central hub and the other component is a cylindrical member attached to an axial shaft and adapted to be attached to the hub and the vane members to drive the fan.

In the By et al. U.S. Pat. No. 5,431,536 a torque converter stator has blades which are integral with inner and outer rim portions and formed by molding of resin material.

The Sekine U.S. Pat. No. 5,655,875 also discloses a plastic torque converter stator made of resin material and having an outer rim and a hub integrally molded with vanes which extend between those components.

The insertable stator vane assembly of the Furseth et al. U.S. Pat. No. 5,547,342 includes stator vanes which are molded of non-metallic composite material and secured to a metallic inner hub and to an outer casing made of metallic material.

The Rasch et al. U.S. Pat. No. 5,813,832 discloses a turbine engine vane segment consisting of a metallic air foil which is mounted between inner and outer metal bands.

SUMMARY OF THE INVENTION

Accordingly, it is an object of the present invention to provide a segmented composite impeller arrangement and manufacturing method which overcome disadvantages of the prior art.

Another object of the invention is to provide a segmented composite impeller arrangement and manufacturing method in which inexpensive resin transfer molding techniques can be utilized while assuring high precision of the completed part and reducing manufacturing costs.

These and other objects of the invention are attained by molding a one-blade segment of an impeller which is designed to interengage with identical adjacent segments to thereby enable a complete impeller to be assembled from a plurality of identical segments. Each of the individual segments can be inspected easily and, machined conveniently to conform to design requirements. The segments are assembled by bonding at their engaging surfaces with a bonding agent which may be an adhesive material or the resin material of which the segments are made to provide a composite structure having a highly precise construction. The assembled segments are then covered by a shroud which can be formed by a veil cloth impregnated with transferred resin.

DESCRIPTION OF THE DRAWINGS

Further objects and advantages of the invention will be apparent from a reading of the following description in conjunction with the accompanying drawings in which.

DESCRIPTION OF PREFERRED EMBODIMENTS

For convenience, the device produced according to the invention is referred to in the specification and claims as an impeller although the invention applies equally to propellers, which may differ in structural arrangement from the described impellers.

Figure 1:
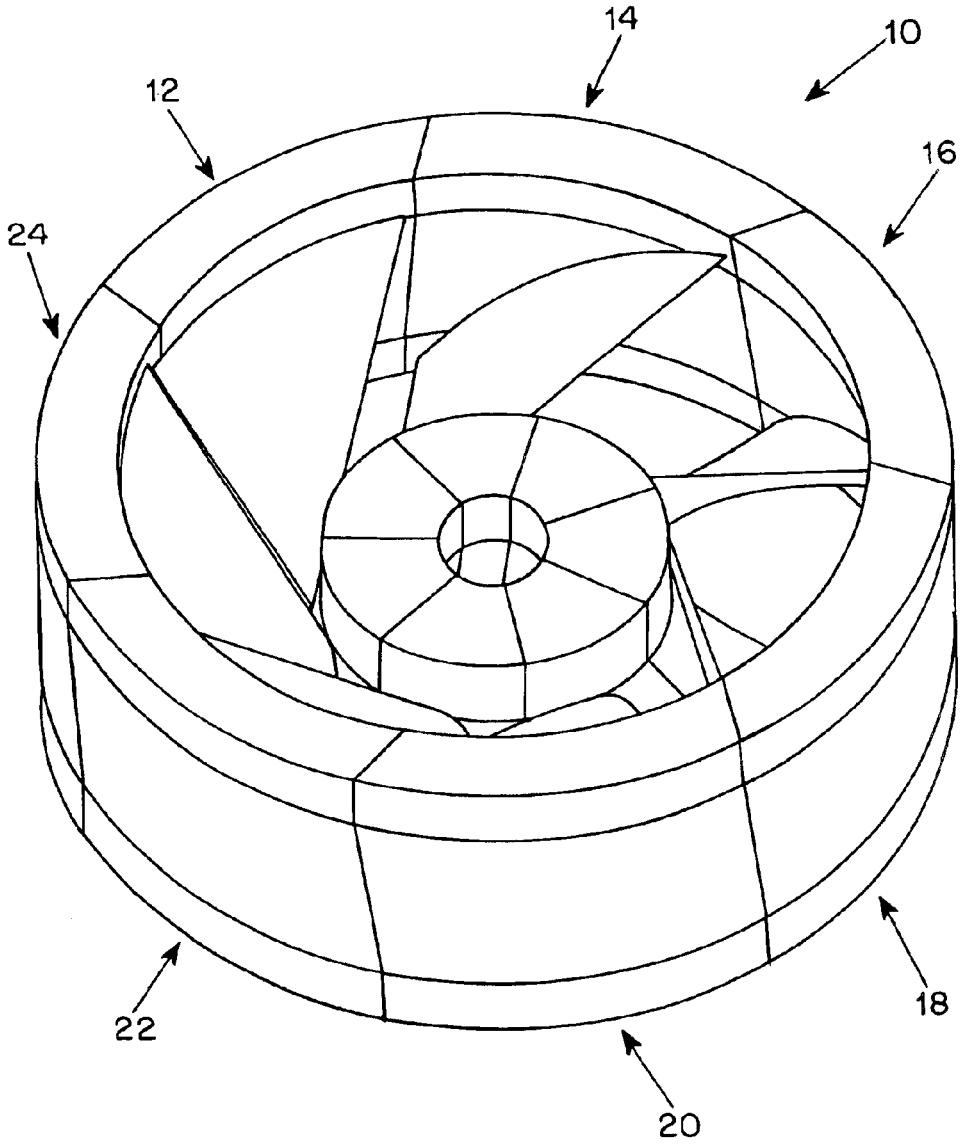
FIG. 1 is a schematic perspective view illustrating a representative embodiment of a segmented composite impeller made in accordance with the invention.

In the typical embodiment of the invention illustrated in the drawings, the basic structure 10 of an impeller is assembled from a plurality of identical segments 12, 14, 16, 18, 20, 22 and 24 as shown in FIG. 1. Although seven impeller segments are shown in the example, the number of segments will vary depending on the number of vanes required for the impeller.

Figure 2:
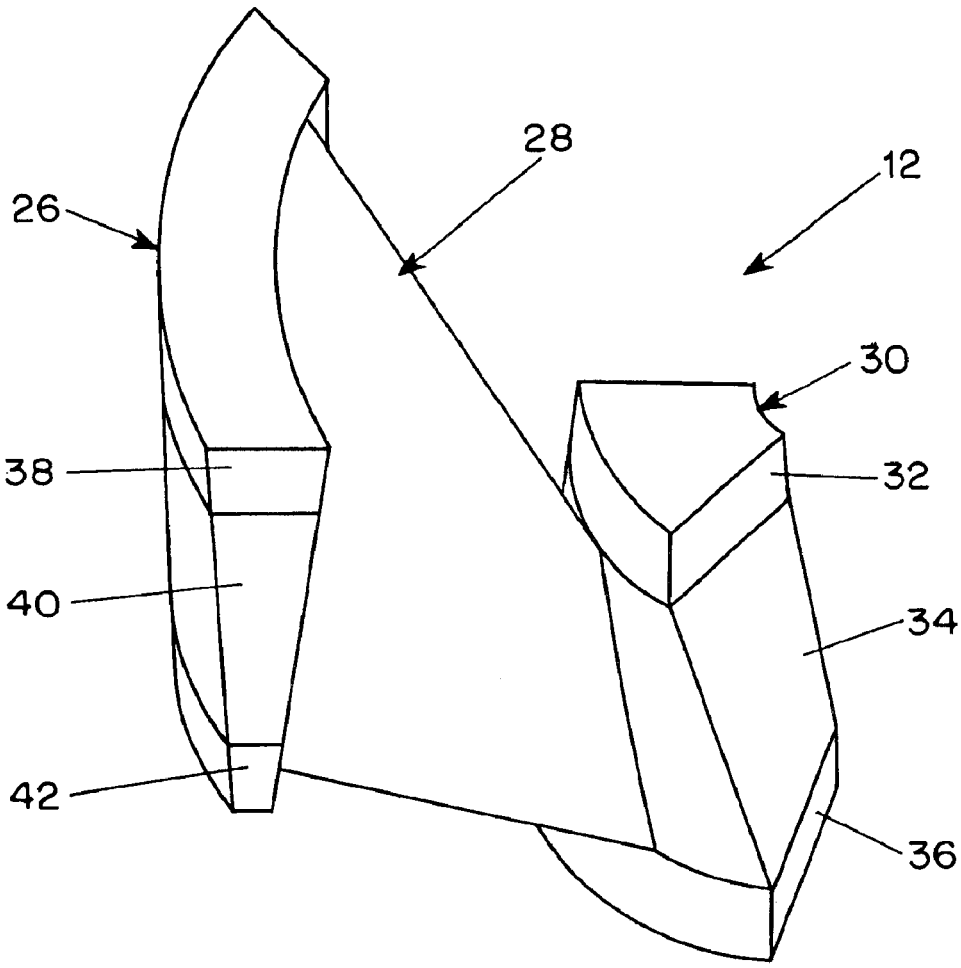
FIG. 2 is a perspective view showing a single segment prepared for the manufacture of an impeller of the type shown in FIG. 1.

A representative impeller segment 12, shown in FIG. 2, consists of a rim portion 26, a vane portion 28, and a hub portion 30 which are integrally molded into a single piece in a mold having the required shape by conventional resin transfer molding techniques. Preferably, all of the segments are molded in the same mold by injecting a high strength resin material such as a fiber-reinforced polymer composite containing gibers chosen from glass, aramid, carbon, polyester and quartz materials to impart rigidity and stability to the segment 12. In the typical embodiment shown in the drawings, the rim portion 26 of each segment is angularly displaced with respect to the corresponding hub portion 30. The extent of any such angular displacement depends on the shape and orientation of the vane portion 28 extending between the vane portion and hub portion.

Figure 3:
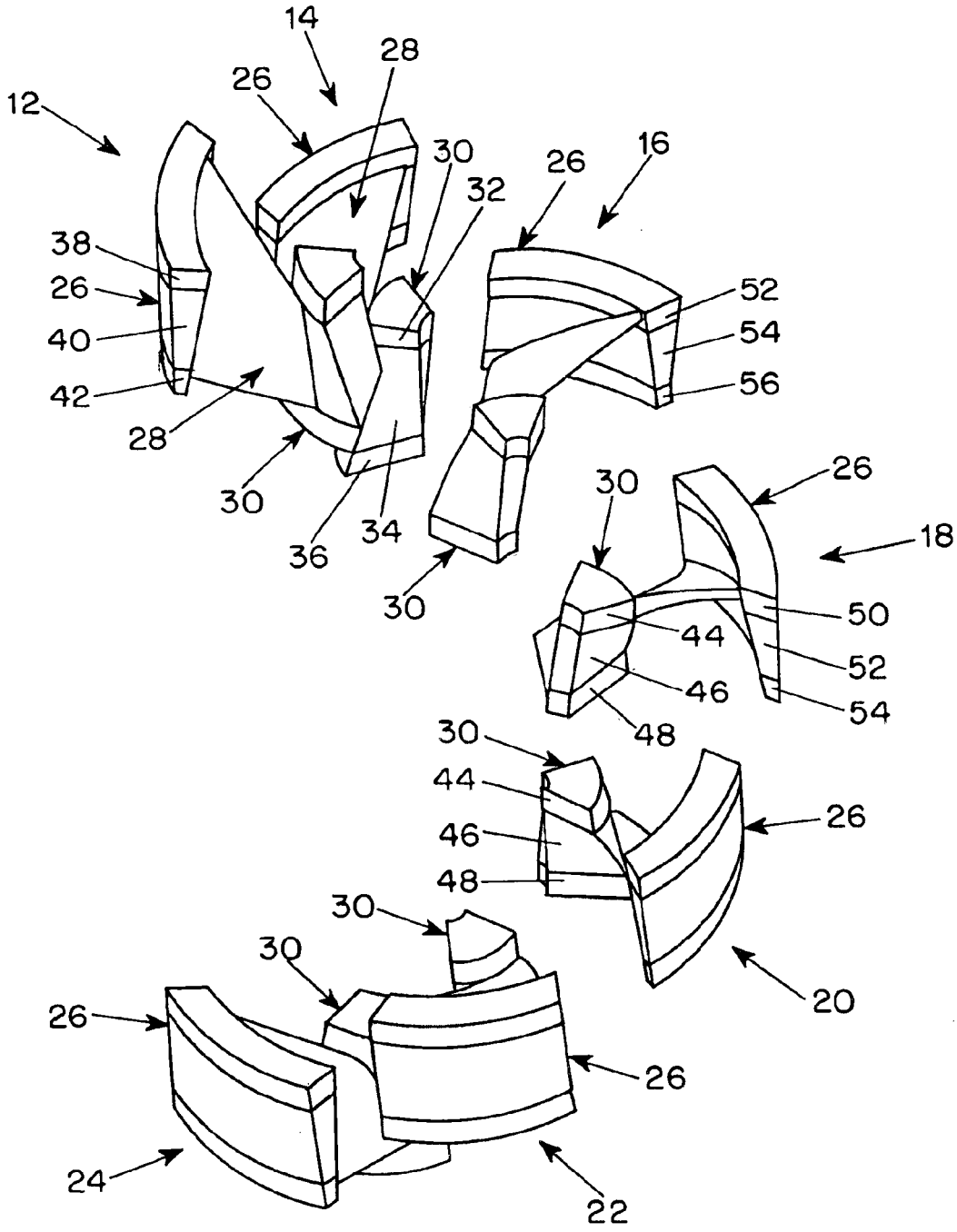
FIG. 3 is a perspective exploded view showing the segments of the impeller shown in FIG. 1 in the relative positions in which they are assembled to produce the impeller.

FIG. 3 illustrates the relative orientations of the segments 12–24 during assembly into the impeller basic structure 10 shown in FIG. 1 and shows that each segment has surfaces 32, 34 and 36 at one edge of the hub portion 30 and 38, 40 and 42 at the corresponding edge of the rim part 26 which are shaped to interengage with the mating surfaces 44, 46, 50 at the opposite edge of the hub portion and 52, 54 and 56 at the opposite edge of the rim portion to produce an assembled unit as shown in FIG. 1. Also, as shown in FIGS. 2 and 3, the upper part of each hub portion 30 having the edge surfaces 32 and 44 is angularly displaced with respect to the lower part having the edge surfaces 36 and 48. The extent of this angular displacement will depend on the shape and orientation of the part of the vane 28 which is joined to the hub portion.

Figure 4:
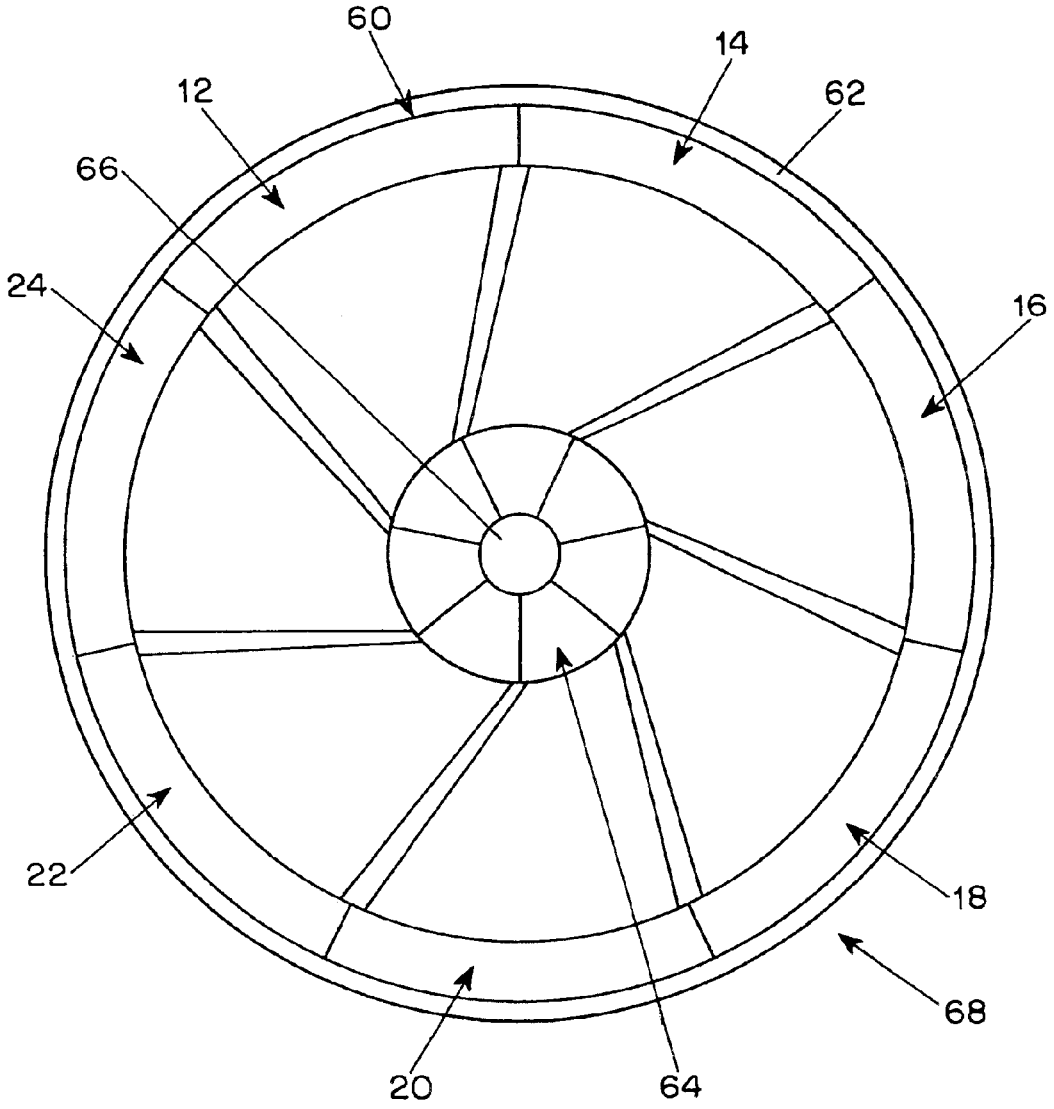
FIG. 4 is an end view of a completed impeller according to the invention.

Before final assembly of the basic impeller structure 10 all of the segments are dry-fitted and inspected for relative position in the structure. The segments are then disassembled and reassembled with a bonding agent applied to the mating surfaces which may be an adhesive or the same resin used to manufacture the segments. The rim 60 formed by the assembled rim segments 26 is then rough machined on the radially outer surface which lifts fibers from the surface of the rim segments. The rim is then reformed by applying a veil cloth 62 to the outer surface of the rim 60 and impregnating the cloth with resin. Thereafter, the hub 64 is bored and a hub piece 66 is bonded to the hub. Then the impeller is completed by finish machining to produce a final impeller structure 68 as shown in FIG. 4.

Although the invention has been described herein with reference to specific embodiments, many modifications and variations therein will readily occur to those skilled in the art. Accordingly, all such variations and modifications are included within the intended scope of the invention.

We claim:

1. An impeller arrangement comprising:

a plurality of substantially identical integrally molded angular segments, each segment including a rim portion, a vane portion and a hub portion, the rim portions and hub portions having end surfaces on opposite angular ends of the segments and the segments being assembled with the end surfaces of the rim and hub portions bonded to corresponding surfaces of adjacent segments, wherein an upper part of each hub portion is angularly displaced with a respective lower part.

2. An impeller arrangement according to claim 1 wherein the end surfaces of the rim and hub portions of adjacent segments are bonded using an adhesive.

3. An impeller arrangement according to claim 1 wherein each segment comprises a fiber-reinforced polymer composite resin material.

4. An impeller arrangement according to claim 3, wherein the composite material contains fibers chosen from glass, aramid, carbon, polyester and quartz materials.

5. An impeller arrangement according to claim 3 wherein the segments are bonded using the same resin material from which the segments are formed.

6. An impeller arrangement according to claim 1 including a radially outer layer surrounding the rim portions of the segments and comprising a resin impregnated veil cloth.

7. An impeller arrangement according to claim 1 wherein the rim portion of each segment is angularly offset from the hub portion of the segment.

8. A method for manufacturing an impeller arrangement comprising:

providing a mold for molding an integral impeller segment containing a rim portion and a hub portion and a vane joining the rim portion and the hub portion, the rim and hub portions each having angularly opposite end surfaces, wherein an upper part of the hub portion is angularly displaced with a respective lower part;

molding a plurality of substantially identical segments using fiber-reinforced resin material; and assembling the plurality of segments into an impeller by bonding the end surfaces of the rim and hub portions of each segment to corresponding end surfaces of rim and hub portions of adjacent segments.

9. A method according to claim 8 including injection molding the fiber-reinforced resin material into the same mold to form each segment.

10. A method according to claim 8 including bonding the end surfaces of the rim and hub portions of each segment to corresponding end surfaces of adjacent segments using an adhesive.

11. A method according to claim 10 including bonding the end surfaces of the rim and hub portions of each segment to corresponding end surfaces of adjacent segments using the same resin material used in forming the segments.

12. A method for manufacturing an impeller arrangement comprising:

providing a mold for molding an integral impeller segment containing a rim portion and a hub portion and a vane joining the rim portion and the hub portion, the rim and hub portions each having angularly opposite end surfaces;

molding a plurality of substantially identical segment using fiber-reinforced resin material;

assembling the plurality of segments into an impeller by bonding the end surfaces of the rim and hub portions of each segment to corresponding end surfaces of rim and hub portions of adjacent segments;

machining the outer surface of the rim portion; and applying a resin-impregnated veil cloth around the outer surface.

13. A method according to claim 8 including inserting a hub piece into an opening provided in the assembled hub portions of the segments.

14. An impeller arrangement, comprising:

a plurality of substantially identically integrally molded angular segments, each segment further comprising:

a rim portion having end surfaces on opposite angular ends of the segment;

a hub portion having end surfaces on opposite angular ends of the segment, wherein an upper part of the hub portion is angular displaced from a lower part of the hub portion; and a vane portion, wherein said end surfaces of the rim and hub portion are bonded with a corresponding surface of adjacent segments to form the impeller arrangement.

15. An impeller arrangement according to claim 14 wherein the end surfaces of the rim and hub portions of adjacent segments are bonded using an adhesive.

16. An impeller arrangement according to claim 14 wherein each segment comprises a fiber-reinforced polymer composite resin material.

17. An impeller arrangement according to claim 16, wherein the composite material contains fibers chosen from glass, aramid, carbon, polyester and quartz materials.

18. An impeller arrangement according to claim 16 wherein the segments are bonded using the same resin material from which the segments are formed.

19. An impeller arrangement according to claim 14 including a radially outer layer surrounding the rim portions of the segments and comprising a resin impregnated veil cloth.

20. An impeller arrangement according to claim 14 wherein the rim portion of each segment is angularly offset from the hub portion of the segment.

* * * * *